US010883160B2

(12) United States Patent
Yamamoto et al.

(10) Patent No.: US 10,883,160 B2
(45) Date of Patent: Jan. 5, 2021

(54) CORROSION AND CREEP RESISTANT HIGH CR FECRAL ALLOYS

(71) Applicant: UT-BATTELLE, LLC, Oak Ridge, TN (US)

(72) Inventors: Yukinori Yamamoto, Knoxville, TN (US); Bruce A. Pint, Knoxville, TN (US); Michael P. Brady, Oak Ridge, TN (US)

(73) Assignee: UT-BATTELLE, LLC, Oak Ridge, TN (US)

( * ) Notice: Subject to any disclaimer, the term of this patent is extended or adjusted under 35 U.S.C. 154(b) by 156 days.

(21) Appl. No.: 16/283,359

(22) Filed: Feb. 22, 2019

(65) Prior Publication Data

US 2019/0264307 A1 Aug. 29, 2019

Related U.S. Application Data

(60) Provisional application No. 62/634,282, filed on Feb. 23, 2018.

(51) Int. Cl.
*C22C 38/54* (2006.01)
*C22C 38/02* (2006.01)
(Continued)

(52) U.S. Cl.
CPC ..... *C22C 38/54* (2013.01); *C21D 8/0273* (2013.01); *C22C 38/001* (2013.01);
(Continued)

(58) Field of Classification Search
CPC ..... C22C 38/54; C22C 38/001; C22C 38/005; C22C 38/02; C22C 38/04; C22C 38/06;
(Continued)

(56) References Cited

U.S. PATENT DOCUMENTS 2,183,715 A 12/1939 Franks et al.
2,432,616 A 12/1947 Franks et al.
(Continued)

FOREIGN PATENT DOCUMENTS

FR 2473069 A1 7/1981
GB 1217933 A 1/1971
JP 2013079428 A * 5/2013

OTHER PUBLICATIONS

JP2013079428A translation (Year: 2013).*

*Primary Examiner* — Anthony J Zimmer
*Assistant Examiner* — Ricardo D Morales
(74) *Attorney, Agent, or Firm* — Fox Rothschild LLP

(57) ABSTRACT

An alloy includes in weight % based upon the total weight of the alloy: 28-35% Cr; 2.5-4% Al; 0.8-2% Nb; 5.5-7.5% W; 0-0.5% Mo; 0-0.3% Ti; 0.1-0.3% Zr; 0.1-1% Si; 0-0.07% Y; 0-2% Mn; 0-1% Ni; 0-0.05% C; 0-0.015% B; 0-0.02% N; 0.02-0.04 Ce; balance Fe. The alloy includes a recrystallized, equi-axed grain structure, and forms an external alumina scale, and has strengthening particles including $Fe_2M$ (M: Nb, W, Mo, and Ti) type C14 Laves-phase, and a BCC ferritic matrix microstructure from room temperature to melting point with less than 1% FCC-phase, less than 1% martensite phase, less than 0.5 wt. % of carbides (MC and $M_{23}C_6$), and at least 1% tensile elongation at room temperature. The alloy provides a creep resistance of greater than 3000 to 15000 h creep rupture life at 750° C. and 50 MPa, or greater than 500 to 5000 h creep rupture life at 700° C. and 100 MPa.

20 Claims, 9 Drawing Sheets

(51) Int. Cl.

| | |
|---|---|
| ***C22C 38/04*** | (2006.01) |
| ***C22C 38/06*** | (2006.01) |
| ***C22C 38/00*** | (2006.01) |
| ***C22C 38/48*** | (2006.01) |
| ***C22C 38/50*** | (2006.01) |
| ***C21D 8/02*** | (2006.01) |
| ***C22C 38/44*** | (2006.01) |

(52) U.S. Cl.
CPC ..... *C22C 38/005* (2013.01); *C22C 38/02* (2013.01); *C22C 38/04* (2013.01); *C22C 38/06* (2013.01); *C22C 38/44* (2013.01); *C22C 38/48* (2013.01); *C22C 38/50* (2013.01); *C21D 8/0205* (2013.01); *C21D 8/0226* (2013.01); *C21D 8/0263* (2013.01); *C21D 2211/005* (2013.01)

(58) Field of Classification Search
CPC ..... C22C 38/44; C22C 38/48; C22C 38/50; C21D 8/0273; C21D 8/0205; C21D 8/0226; C21D 8/0263; C21D 2211/005
See application file for complete search history.

(56) References Cited

U.S. PATENT DOCUMENTS

| | | | |
|---|---|---|---|
| 3,856,515 | A | 12/1974 | Brandis et al. |
| 4,179,285 | A | 12/1979 | Tanczyn |
| 4,255,497 | A | 3/1981 | Bond et al. |
| 4,464,207 | A | 8/1984 | Kindlimann |
| 4,515,644 | A | 5/1985 | Sawatani et al. |
| 4,859,649 | A | 8/1989 | Bohnke et al. |
| 4,960,562 | A | 10/1990 | Okuda et al. |
| 5,228,932 | A | 7/1993 | Shimizu et al. |
| 5,230,752 | A | 7/1993 | Bourgain et al. |
| 5,591,531 | A | 1/1997 | Jasper |
| 6,296,953 | B1 | 10/2001 | Linden et al. |
| 6,692,585 | B2 | 2/2004 | Uehara et al. |
| 6,737,186 | B2 | 5/2004 | Janousek et al. |
| 7,005,105 | B2 | 2/2006 | Lee et al. |
| 9,080,230 | B2 | 7/2015 | Hahn et al. |
| 2010/0092749 | A1 | 4/2010 | Hattendorf et al. |
| 2012/0145285 | A1 | 6/2012 | Hattendorf et al. |
| 2014/0219855 | A1 | 8/2014 | Hattendorf et al. |

* cited by examiner (a) 1Nb-6W (CC15-2, 1500h)

(b) Binary Fe-30Cr (RF30C, 500h)

CORROSION AND CREEP RESISTANT HIGH CR FECRAL ALLOYS

CROSS-REFERENCE TO RELATED APPLICATIONS

This application claims priority to U.S. Provisional Application 62/634,282 filed on Feb. 23, 2018, entitled "Corrosion and Creep Resistant High Cr FeCrAl Alloys", the entire disclosure of which incorporated herein by reference.

STATEMENT REGARDING FEDERALLY SPONSORED RESEARCH AND DEVELOPMENT

This invention was made with government support under Contract No. DE-AC05-00OR22725 awarded by the U.S. Department of Energy. The government has certain rights in this invention.

FIELD OF THE INVENTION

The present invention relates generally to metal alloys, and more particularly to FeCrAl alloys.

BACKGROUND OF THE INVENTION

Traditional creep strength enhanced ferritic (CSEF) steels, such as ferritic-martensitic (FM) steels containing 9-12 wt. % Cr such as Gr 91, 92, and 122, are now extensively used in coal-fired boilers, heat-recovery steam generators, and steam piping systems in fossil-fired power plants because of their excellent creep properties up to 600-620° C., matched with reasonable material costs. The high temperature strength of CSEF steels relies on martensitic microstructure combined with carbide formation. The nature of martensitic microstructure evolution through phase transformation dictates that CSEF steels cannot be used above ~650° C. due to promotion of microstructure instability. In addition, CSEF steel weldments suffer from premature failures due to Type IV failures at the fine-grained heat affected zone (FGHAZ). Formation of the FGHAZ is attributed to α' (BCT, martensite) and to γ (FCC, austenite) reverse transformation in the base metal adjacent to the weld due to heating above Ac1, phase transformation temperature to form FCC-phase structure (e.g. ~820° C. for Gr 91), indicating that the formation of weakened microstructure consisting of fine grains cannot completely be eliminated in traditional FM steel weldments. In order to avoid such creep property degradation at the FGHAZ, a development of fully ferritic steel alloy has been proposed which should be essentially free from α-γ phase transformation, and therefore, no Type IV failure. Compared to traditional FM steels, the reduced thermal instability of the microstructure in the ferritic steel alloys has the advantage of maintaining the controlled microstructure for high-temperature strength at higher temperature than the upper limit in FM steels. However, it also raises requirements in the alloy design that require improved environmental compatibility in more aggressive corrosive/oxidized environments at elevated service temperatures.

SUMMARY OF THE INVENTION

An alloy according to the invention comprises in weight % based upon the total weight of the alloy:

28-35% Cr
2.5-4% Al
0.8-2% Nb
5.5-7.5% W
0-0.5% Mo
0-0.3% Ti
0.1-0.3% Zr
0.1-1% Si
0-0.07% Y
0-2% Mn
0-1% Ni
0-0.05% C
0-0.015% B
0-0.02% N
0.02-0.04 Ce balance Fe. The alloy comprises at least 99% recrystallized, at least 99% equi-axed grain structure with an average grain size of 10 to 100 μm. The alloy forms an external continuous scale comprising alumina, and has nanometer scale sized strengthening particles with 5 to 500 nm in size and mole fraction of 5 to 10%, distributed throughout the microstructure. The particles comprise at least one composition selected from the group consisting of $Fe_2M$ (M: Nb, W, Mo, and Ti) type C14 Laves-phase, and a stable essentially single-phase BCC ferritic matrix microstructure from room temperature to melting point. The ferritic matrix can be less than 1% FCC-phase, less than 1% martensite phase, less than 0.5 wt. % of carbides (MC and $M_{23}C_6$), with at least 1% tensile elongation at room temperature. The alloy can have an oxidation resistance of a positive specific mass change less than 0.5 mg/cm$^2$ after 5000 h exposure at 800° C. in air with 10 volume percent $H_2O$. The alloy can have an ash-corrosion resistance of a positive specific mass change less than 2 mg/cm$^2$ after 1000 h exposure at 700° C. in a synthetic ash and gas environment. The alloy can have a creep resistance of greater than 3000 to 15000 h creep rupture life at 750° C. and 50 MPa, and/or greater than 500 to 5000 h creep rupture life at 700° C. and 100 MPa.

The Cr can be 30-35 wt. %. The Al can be 3-4 wt. %. The Nb can be 1-2 wt. %. The W can be 6-7.5 wt. %. The Si can be 0.15-1 wt. %. The Y can be 0.01-0.07 wt. %. The Ce can be 0.03-0.04 wt. %. The Mn can be 0.4 to 2 wt. %. The C can be <0.035 wt. %. The B can be 0.01 to 0.015 wt. %. The N can be 0 to 0.005 wt. %.

The average grain size can be 10-50 μm. The strengthening particles can be 5-300 nm in size. The mole fraction of the particles can be 6-8%.

The alloy can consist essentially of 28-35% Cr; 2.5-4% Al; 0.8-2% Nb; 5.5-7.5% W; 0-0.5% Mo; 0-0.3% Ti; 0.1-0.3% Zr; 0.1-1% Si; 0-0.07% Y; 0-2% Mn; 0-1% Ni; 0-0.05% C; 0-0.015% B; 0-0.02% N; 0.02-0.04 Ce; balance Fe, and no more than 1% of trace elements.

The alloy can consist of 28-35% Cr; 2.5-4% Al; 0.8-2% Nb; 5.5-7.5% W; 0-0.5% Mo; 0-0.3% Ti; 0.1-0.3% Zr; 0.1-1% Si; 0-0.07% Y; 0-2% Mn; 0-1% Ni; 0-0.05% C; 0-0.015% B; 0-0.02% N; 0.02-0.04 Ce; balance Fe.

A method of making an alloy can include the step of providing an alloy precursor composition comprising 28-35% Cr; 2.5-4% Al; 0.8-2% Nb; 5.5-7.5% W; 0-0.5% Mo; 0-0.3% Ti; 0.1-0.3% Zr; 0.1-1% Si; 0-0.07% Y; 0-2% Mn; 0-1% Ni; 0-0.05% C; 0-0.015% B; 0-0.02% N; 0.02-0.04 Ce; balance Fe. The alloy precursor composition is heated to form an alloy. The alloy is subjected to a controlled thermomechanical treatment consisting of a combination of hot-forging and -rolling with total deformation (e.g. thickness reduction) more than 70% and multiple re-heating process steps at an intermediate temperature between 800 and 1000° C. during hot-forging and -rolling. The alloy is then subjected to recrystallization through annealing at a temperature between 1150 to 1250° C., to achieve a fully recrystallized, equi-axed grain structure with the average grain size of 10 to 100 μm, and at least 1% tensile elongation at room temperature. The annealing temperature can be 1200° C. The average grain size can be 10 to 50 μm.

BRIEF DESCRIPTION OF THE DRAWINGS

There are shown in the drawings embodiments that are presently preferred it being understood that the invention is not limited to the arrangements and instrumentalities shown, wherein:

FIG. 2B: the BCC solvus temperature, ° C. vs. Additional element, wt. %, for Fe-30Cr-3Al-1Nb-0.15Si-0.4Mn-0.3Ni-0.03C base alloys.

in FIG. 4A at 700° C., and in FIG. 4B at 750° C.

in FIG. 5A with various changes in Al, Nb, and Zr, and in FIG. 5B with various changes in Cr, W, Ti, and Mo, compared with a reference binary Fe-30Cr alloy.

FIG. 7A shows Fe-30Cr-3Al-1Nb-6W base alloy (CC15-2) specimen, after 1500 h exposure, and FIG. 7B shows a reference binary Fe-30Cr (RF30C) specimen, after 500 h exposure.

DETAILED DESCRIPTION OF THE INVENTION

Figure 1:
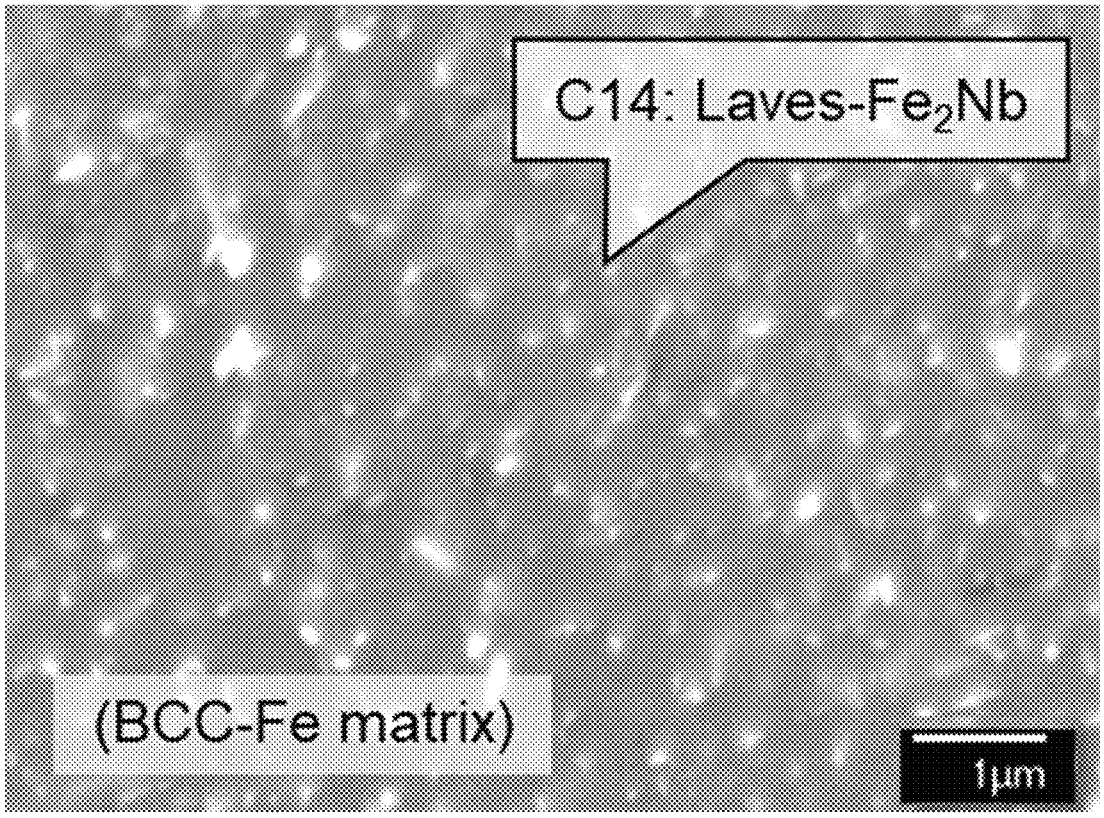
FIG. 1 is a SEM-BSE image showing a microstructure of Laves phase precipitates dispersed in the BCC matrix in an Fe-30Cr-3Al-1Nb-2W-0.2Si alloy after aging at 700° C. for 168 h.

An alloy according to the invention comprises in weight % based upon the total weight of the alloy: 28-35% Cr; 2.5-4% Al; 0.8-2% Nb; 5.5-7.5% W; 0-0.5% Mo; 0-0.3% Ti; 0.1-0.3% Zr; 0.1-1% Si; 0-0.07% Y; 0-2% Mn; 0-1% Ni; 0-0.05% C; 0-0.015% B; 0-0.02% N; 0.02-0.04 Ce; balance Fe. The alloy comprises at least 99% recrystallized, at least 99% equi-axed grain structure with an average grain size of 10 to 100 μm. The alloy forms an external continuous scale comprising alumina. The alloy has nanometer scale sized strengthening particles with 5 to 500 nm in size and mole fraction of 5 to 10% distributed throughout the microstructure. The particles comprise at least one composition selected from the group consisting of $Fe_2M$ (M: Nb, W, Mo, and Ti) type C14 Laves-phase. The alloy possesses a stable essentially single-phase BCC ferritic matrix microstructure from room temperature to melting point. The ferritic matrix can be less than 1% FCC-phase, and less than 1% martensite phase. The alloy can have less than 0.5 wt. % of carbides (MC and $M_{23}C_6$). The alloy can have at least 1% tensile elongation at room temperature.

The alloy has an oxidation resistance of a positive specific mass change less than 0.5 $mg/cm^2$ after 5000 h exposure at 800° C. in air with 10 volume percent $H_2O$. The alloy has an ash-corrosion resistance of a positive specific mass change less than 2 $mg/cm^2$ after 1000 h exposure at 700° C. in a synthetic ash and gas environment. The alloy has a creep resistance of greater than 3000 to 15000 h creep rupture life at 750° C. and 50 MPa. The alloy can have greater than 500 to 5000 h creep rupture life at 700° C. and 100 MPa.

The Cr content can be 28, 28.5, 29.0, 29.5, 30.0, 30.5, 31.0, 31.5, 32.0, 32.5, 33.0, 33.5, 34.0, 34.5, to 35.0 wt. %, or within a range of any high value and low value selected from these values. The Cr can be 30-35 wt. %.

The Al content can be 2.5, 2.6, 2.7, 2.8, 2.9, 3.0, 3.1, 3.2, 3.3, 3.4, 3.5, 3.6, 3.7, 3.8, 3.9, to 4.0 wt. %, or within a range of any high value and low value selected from these values. The Al can be 3-4 wt. %.

The Nb content can be 0.8, 0.9, 1.0, 1.1, 1.2, 1.3, 1.4, 1.5, 1.6, 1.7, 1.8, 1.9, to 2.0 wt. %, or within a range of any high value and low value selected from these values. The Nb can be 1-2 wt. %.

The W content can be 5.5, 5.6, 5.7, 5.8, 5.9, 6.0, 6.1, 6.2, 6.3, 6.4, 6.5, 6.6, 6.7, 6.8, 6.9, 7.0, 7.1, 7.2, 7.3, 7.4, to 7.5 wt. %, or within a range of any high value and low value selected from these values. The W can be 6-7.5 wt. %.

The Mo content can be 0, 0.05, 0.1, 0.15, 0.20, 0.25, 0.30, 0.35, 0.4, 0.45, to 0.5 wt. %, or within a range of any high value and low value selected from these values.

The Ti content can be 0, 0.05, 0.10, 0.15, 0.20, 0.25, to 0.3% wt. %. The Ti can be within a range of any high value and low value selected from these values.

The Zr content can be 0.1, 0.15, 0.20, 0.25, to 0.30 wt. %. The Zr can be within a range of any high value and low value selected from these values.

The Si content can be 0.1, 0.11, 0.12, 0.13, 0.14, 0.15, 0.16, 0.17, 0.18, 0.19, 0.20, 0.21, 0.22, 0.23, 0.24, 0.25, 0.26, 0.27, 0.28, 0.29, 0.30, 0.31, 0.32, 0.33, 0.34, 0.35, 0.36, 0.37, 0.38, 0.39, 0.40, 0.41, 0.42, 0.43, 0.44, 0.45, 0.46, 0.47, 0.48, 0.49, 0.50, 0.51, 0.52, 0.53, 0.54, 0.55, 0.56, 0.57, 0.58, 0.59, 0.6, 0.61, 0.62, 0.63, 0.64, 0.65, 0.66, 0.67, 0.68, 0.69, 0.70, 0.71, 0.72, 0.73, 0.74 0.75, 0.76, 0.77, 0.78, 0.79, 0.80, 0.81, 0.82, 0.83, 0.84, 0.85, 0.86, 0.87, 0.88, 0.89, 0.90, 0.91 0.92, 0.93, 0.94, 0.95, 0.96, 0.97, 0.98, 0.99, to 1.0 wt. %, or within a range of any high value and low value selected from these values. The Si content can be 0.15-1 wt. %.

The Y content can be 0, 0.01, 0.02, 0.03, 0.04, 0.05, 0.06, to 0.07 wt. %, or within a range of a any high value and low value selected from these values. The Y content can be 0.01-0.07 wt. %.

The Mn content can be 0, 0.25, 0.50, 0.75, 1.0, 1.25, 1.50, 1.75, to 2 wt. %, or within a range of any high value and low value selected from these values. The Mn content can be 0.4 to 2 wt. %.

The Ni content can be 0, 0.1, 0.11, 0.12, 0.13, 0.14, 0.15, 0.16, 0.17, 0.18, 0.19, 0.20, 0.21, 0.22, 0.23, 0.24, 0.25, 0.26, 0.27, 0.28, 0.29, 0.30, 0.31, 0.32, 0.33, 0.34, 0.35, 0.36, 0.37, 0.38, 0.39, 0.40, 0.41, 0.42, 0.43, 0.44, 0.45, 0.46, 0.47, 0.48, 0.49, 0.50, 0.51, 0.52, 0.53, 0.54, 0.55, 0.56, 0.57, 0.58, 0.59, 0.6, 0.61, 0.62, 0.63, 0.64, 0.65, 0.66, 0.67, 0.68, 0.69, 0.70, 0.71, 0.72, 0.73, 0.74 0.75, 0.76, 0.77, 0.78, 0.79, 0.80, 0.81, 0.82, 0.83, 0.84, 0.85, 0.86, 0.87, 0.88, 0.89, 0.90, 0.91 0.92, 0.93, 0.94, 0.95, 0.96, 0.97, 0.98, 0.99, to 1.0 wt. %, or within a range of any high value and low value selected from these values.

The C content can be 0, 0.005, 0.01, 0.015, 0.02, 0.025, 0.03, 0.035, 0.04, 0.045 to 0.05 wt. %, or within a range of any high value and low value selected from these values. The C content can be 0.01 to 0.05 wt. %, with less than 0.035 preferred.

The B can be 0, 0.001, 0.002, 0.003, 0.004, 0.005, 0.006, 0.007, 0.008, 0.009, 0.010, 0.011, 0.012, 0.013, 0.014, to 0.015%, or within a range of any high value and low value selected from these values. The B content can be 0.01 to 0.015 wt. %, The N content can be 0, 0.001, 0.002, 0.003, 0.004, 0.005, 0.006, 0.007, 0.008, 0.009, 0.010, 0.011, 0.012, 0.013, 0.014, 0.015, 0.016, 0.017, 0.018, 0.019 to 0.02 wt. %, or within a range of any high value and low value selected from these values. The N content can be 0 to 0.005 wt. %, The Ce content can be 0.02, 0.021, 0.022, 0.023, 0.024, 0.025, 0.026, 0.027, 0.028, 0.029, 0.030, 0.031, 0.032, 0.033, 0.034, 0.035, 0.036, 0.037, 0.038, 0.039, to 0.040 wt. %, or within a range of any high value and low value selected from these values. The Ce content can be 0.03-0.04 wt. %, The alloy can have at least 99% recrystallized grain structure. The alloy can have a recrystallized grain structure that is at least 99, 99.1, 99.2, 99.3, 99.4, 99.5, 99.6, 99.7, 99.8, 99.9 to 100%, or within a range of any high value and low value selected from these values.

The alloy can have at least 99% equi-axed grain structure. The alloy can have a equi-axed grain structure that is at least 99, 99.1, 99.2, 99.3, 99.4, 99.5, 99.6, 99.7, 99.8, 99.9 to 100%, or within a range of any high value and low value selected from these values.

The alloy can have an average grain size of 10, 15, 20, 25, 30, 35, 40, 45, 50, 55, 60, 65, 70, 75, 80, 85, 90, 95, to 100 μm, or within a range of any high value and low value selected from these values. The alloy can have an average grain size of 10-50 μm.

The alloy forms an external continuous scale comprising alumina.

The alloy has nanometer scale sized strengthening particles with a diameter of from 5 to 500 nm. The strengthening particles can have an average size of 5, 6, 7, 8, 9, 10, 15, 20, 30, 40, 50, 60, 70, 80, 90, 100, 110, 120, 130, 140, 150, 160, 170, 180, 190, 200, 210, 220, 230, 240, 250, 260, 270, 280, 290, 300, 310, 320, 330, 340, 350, 360, 370, 380, 390, 400, 410, 420, 430, 440, 450, 460, 470, 480, 490 to 500 nm, or within a range of any high value and low value selected from these values. The strengthening particles can have an average size 5-300 nm.

The mole fraction of the strengthening particles can be 5, 5.5, 6.0, 6.5, 7.0, 7.5, 8.0, 8.5, 9.0, 9.5, to 10%, or within a range of any high value and low value selected from these values. The mole fraction of the strengthening particles can be 6-8%. The strengthening particles can be distributed throughout the microstructure. The strengthening particles can include at least one composition selected from the group consisting of $Fe_2M$ (M: Nb, W, Mo, and Ti) type C14 Laves-phase.

The alloy provides a stable essentially single-phase BCC ferritic matrix microstructure from room temperature to melting point. The ferritic matrix can be less than 1% FCC phase. The ferritic matrix can be 0, 0.1, 0.2, 0.3, 0.4, 0.5, 0.6, 0.7, 0.8, 0.9, to 1.0% FCC-phase, or within a range of any high value and low value selected from these values. The ferritic matrix can be less than 1% martensitic phase. The ferritic matrix can be 0, 0.1, 0.2, 0.3, 0.4, 0.5, 0.6, 0.7, 0.8, 0.9, to 1.0% martensite phase, or within a range of any high value and low value selected from these values. The ferritic matrix can have less than 0.5 wt. % of carbides (MC and $M_{23}C_6$). The ferritic matrix can have 0, 0.05, 0.1, 0.15, 0.20, 0.25, 0.30, 0.35, 0.40, 0.45, to 0.50 wt. % carbides (MC and $M_{23}C_6$), or within a range of any high value and low value selected from these values.

The alloy provides at least 1% tensile elongation at room temperature.

The alloy has an oxidation resistance of a positive specific mass change less than 0.5 mg/cm$^2$ after 5000 h exposure at 800° C. in air with 10 volume percent $H_2O$. The positive specific mass change can be 0, 0.01, 0.05, 0.10, 0.15, 0.20, 0.25, 0.30, 0.35, 0.40, 0.45, to 0.50 mg/cm$^2$ after 5000 h exposure at 800° C. in air with 10 volume percent $H_2O$, or within a range of any high value and low value selected from these values.

The alloy can have an ash-corrosion resistance of a positive specific mass change less than 2 mg/cm$^2$ after 1000 h exposure at 700° C. in a synthetic ash and gas environment simulating a fire side circumstance of fossil-fired thermal power plants, where the ash consists of a mixture of metal oxides, oxy-hydrides, and sulphates, and the gas consists of a mixture of carbon-dioxide, sulfur-dioxide, nitrogen, oxygen, and water. The alloy can have an ash-corrosion resistance of a positive specific mass change of 0, 0.01, 0.05, 0.10, 0.15, 0.20, 0.25, 0.30 0.35, 0.40, 0.45, 0.50, 0.55, 0.60, 0.65, 0.70, 0.75, 0.80, 0.85, 0.90, 0.95, 1.0, 1.05, 1.10, 1.15, 1.20, 1.25, 1.30, 1.35, 1.40, 1.45, 1.50, 1.55, 1.60, 1.65, 1.70, 1.75, 1.80, 1.85, 1.90, 1.95, to 2.0 mg/cm$^2$ after 1000 h exposure at 700° C. in a synthetic ash and gas environment, or within a range of any high value and low value selected from these values.

The alloy can have a creep resistance of 3000 to 15000 h creep rupture life at 750° C. and 50 MPa. The alloy can have a creep resistance of 3000, 3100, 3200, 3300, 3400, 3500, 3600, 3700, 3800, 3900, 4000, 4100, 4200, 4300, 4400, 4500, 4600, 4700, 4800, 4900, 5000, 5100, 5200, 5300, 5400, 5500, 5600, 5700, 5800, 5900, 6000, 6100, 6200, 6300, 6400, 6500, 6600, 6700, 6800, 6900, 7000, 7100, 7200, 7300, 7400, 7500, 7600, 7700, 7800, 7900, 8000, 8100, 8200, 8300, 8400, 8500, 8600, 8700, 8800, 8900, 9000, 9100, 9200, 9300, 9400, 9500, 9600, 9700, 9800, 9900, 10000, 10100, 10200, 10300, 10400, 10500, 10600, 10700, 10800, 10900, 11000, 11100, 11200, 11300, 11400, 11500, 11600, 11700, 11800, 11900, 12000, 12100, 12200, 12300, 12400, 12500, 12600, 12700, 12800, 12900, 13000, 13100, 13200, 13300, 13400, 13500, 13600, 13700, 13800, 13900, 14000, 14100, 14200, 14300, 14400, 14500, 14600, 14700, 14800, 14900, to 15000 h creep rupture life at 750° C. and 50 MPa, or within a range of any high value and low value selected from these values.

The alloy can have creep resistance of 500 to 5000 h creep rupture life of at 700° C. and 100 MPa. The alloy can have creep resistance of 500, 550, 600, 650, 700, 750, 800, 850, 900, 950, 1000, 1050, 1100, 1150, 1200, 1250, 1300, 1350, 1400, 1450, 1500, 1550, 1600, 1650, 1700, 1750, 1800, 1850, 1900, 1950, 2000, 2050, 2100, 2150, 2200, 2250, 2300, 2350, 2400, 2450, 2500, 2550, 2600, 2650, 2700, 2750, 2800, 2850, 2900, 2950, 3000, 3050, 3150, 3200, 3250, 3300, 3350, 3400, 3450, 3500, 3550, 3600, 3650, 3700, 3750, 3800, 3850, 3900, 3950, 4000, 4050, 4150, 4200, 4250, 4300, 4350, 4400, 4450, 4500, 4550, 4600, 4650, 4700, 4750, 4800, 4850, 4900, 4950, to 5000 h creep rupture life at 700° C. and 100 MPa, or within a range of any high value and low value selected from these values.

The alloy can consist essentially of, in weight % based upon the total weight of the alloy: 28-35% Cr; 2.5-4% Al; 0.8-2% Nb; 5.5-7.5% W; 0-0.5% Mo; 0-0.3% Ti; 0.1-0.3% Zr; 0.1-1% Si; 0-0.07% Y; 0-2% Mn; 0-1% Ni; 0-0.05% C; 0-0.015% B; 0-0.02% N; 0.02-0.04 Ce; balance Fe. The alloy can have no more than 1% of trace elements. The alloy can have 0, 0.1, 0.2, 0.3, 0.4, 0.5, 0.6, 0.7, 0.8, 0.9, to 1 wt. % trace elements, or within a range of any high and low value selected from these values.

The alloy can consist of, in weight % based upon the total weight of the alloy: 28-35% Cr; 2.5-4% Al; 0.8-2% Nb; 5.5-7.5% W; 0-0.5% Mo; 0-0.3% Ti; 0.1-0.3% Zr; 0.1-1% Si; 0-0.07% Y; 0-2% Mn; 0-1% Ni; 0-0.05% C; 0-0.015% B; 0-0.02% N; 0.02-0.04 Ce; balance Fe.

A method of making an alloy includes the step of providing an alloy precursor composition comprising 28-35% Cr; 2.5-4% Al; 0.8-2% Nb; 5.5-7.5% W; 0-0.5% Mo; 0-0.3% Ti; 0.1-0.3% Zr; 0.1-1% Si; 0-0.07% Y; 0-2% Mn; 0-1% Ni; 0-0.05% C; 0-0.015% B; 0-0.02% N; 0.02-0.04 Ce; balance Fe.

The alloy precursor composition is heated to form an alloy. The alloy is subjected to a controlled thermomechanical treatment consisting of a combination of hot-forging and -rolling with total deformation (e.g. thickness reduction) more than 70% and multiple re-heating process steps. The re-heating process steps can include heating to an intermediate temperature between 800 and 1000° C. during hot-forging and -rolling. The intermediate temperature heating can be followed by recrystallization through annealing at a temperature between 1150 to 1250° C. A preferred temperature is about 1200° C. This will achieve a fully recrystallized, equi-axed grain structure with the average grain size of 10 to 100 μm, and at least 1% tensile elongation at room temperature. A grain size of 10 to 50 μm can be obtained.

Example alloys of the invention in one embodiment have a composition range of Fe—Cr—Al base ferritic alloy, shown in Table 1, with a target composition nominally consisting of Fe-30Cr-3Al-1Nb-6W with controlled minor alloying additions of Mo, Ti, Zr, Si, Y, Ce, and potential minor impurities of Mn, Ni, C, B, and N. The Example 3 alloy exhibits a combination of (1) high-temperature creep resistance up to 750° C., (2) oxidation resistance in water-vapor containing environments up to 800° C., and (3) ash-corrosion resistance simulating fire-side environments in coal-fired thermal power plants. Existing commercial families of Fe—Cr—Al base ferritic alloys are widely known for their ability to form protective alumina scales to achieve good oxidation resistance, but have very poor creep strength at elevated temperatures which typically limits their use to non-structural, non-loaded components such as heating elements. Creep resistant types of Fe—Cr—Al base alloys are known, but they rely on powder metallurgical dispersion strengthening approaches to achieve creep resistance (e.g. oxide dispersions), which greatly increases cost, and can limit amenability to conventional joining techniques and product forms. The ferritic alloys of the present invention achieve creep strength while remaining amenable to conventional, lower cost metallurgical processing techniques, and do not employ powder processing or oxide dispersions.

TABLE 1

Alloy composition range and a target composition

| Mass % | Fe | Cr | Al | Nb | W | Mo | Ti | Si | Zr | Ce | Y | Mn | Ni | C | B | N |
|---|---|---|---|---|---|---|---|---|---|---|---|---|---|---|---|---|
| Maximum | Balance. | 35 | 4 | 2 | 7.5 | 0.5 | 0.3 | 1 | 0.3 | 0.04 | 0.07 | 2 | 1 | 0.05 | 0.015 | 0.02 |
| Target | Balance. | 30 | 3 | 1 | 6 | | | 0.15 | 0.3 | 0.03 | 0.03 | 0.4 | 0.3 | <0.035 | | <0.005 |
| Minimum | Balance. | 28 | 2.5 | 0.8 | 5.5 | 0 | 0 | 0.1 | 0.1 | 0.02 | 0 | 0 | 0 | 0 | 0 | 0 |
| Maximum | Balance. | 35 | 4 | 2 | 7.5 | 0.5 | 0.3 | 1 | 0.3 | 0.04 | 0.07 | 2 | 1 | 0.07 | 0.015 | 0.01 |
| Example 3 | Balance. | 30 | 3 | 1 | 6 | | | 0.15 | 0.3 | 0.03 | 0.03 | 0.4 | 0.3 | 0.03 | | <0.005 |
| Minimum | Balance. | 28 | 2.5 | 0.8 | 5.5 | 0 | 0 | 0.1 | 0.1 | 0.02 | 0 | 0 | 0 | 0 | 0 | 0 |

The alloy has a base alloy composition of Fe-30Cr-3Al-(1-2) Nb in weight percent, which consists of ferritic (BCC—Fe) matrix with essentially less than 1% FCC—Fe and less than 1% martensite-phase. The alloy provides oxidation and corrosion resistance by the combination of high Cr+Al+Nb contents. The alloy also provides very significant creep performance through the precipitate strengthening provided by the C14-$Fe_2Nb$ Laves phase base precipitates. The alloy exhibits a combination of high-temperature creep resistance up to 800° C., high-temperature oxidation resistance in water-vapor containing environments up to 800° C., and ash-corrosion resistance simulating fire-side environments in coal-fired thermal power plants.

The ferritic alloy based on Fe-30Cr-3Al-1Nb-6W with minor additions of Mo, Ti, Zr, Si, Y, Ce, Mn, Ni, and C achieved creep-rupture performance comparable to 316H type austenitic stainless steel (Fe-18Cr-12Ni-Mo base). The austenitic stainless steels are usually much better in creep strength than ferritics, but exhibit higher thermal expansion and lower thermal conductivity than ferritics, which can be a disadvantage in some high temperature chemical, conversion, and/or combustion system applications, including where thermal fatigue is a concern. The controlled second-phase precipitation of $Fe_2M$ (M: Nb, W, Mo, and Ti) type C14-Laves phase with the size range of 5 to 500 nm, preferred 5 to 300 nm, and the mole fraction of 5 to 10%, targeting 6 to 8%, in the ferritic matrix (BCC, body-centered-cubic structure).

FIG. 1 is a SEM-BSE image showing a typical microstructure of Laves phase precipitates (bright contrast) dispersed in the BCC matrix in the alloy Fe-30Cr-3Al-1Nb-2W-0.2Si after aging at 700° C. for 168 h. As shown in FIG. 1, the alloy demonstrates increased creep deformation resistance through precipitation strengthening. Fine and dense dispersion of the second-phase precipitates requires high supersaturation of Laves phase in the BCC matrix by quenching after the solution heat treatment (~1200° C.), and the greater amount of Laves phase at the target service temperatures (~700° C.) provides improved creep resistance. The alloy achieved the large amount of Laves phase formation (more than 6 mole %) despite no significant detriment in oxidation and corrosion resistance. The BCC solvus temperature, the lower limit temperature to fully dissolve Laves phase into the BCC matrix, should be as reasonably low temperature as possible, for example not exceeding 1200° C., to avoid unnecessary grain coarsening in the BCC matrix during solution heat treatment to avoid a poor room-temperature ductility and fall within a conventional solution heat treatment temperature range that can be readily achieved in commercial scale processing.

Figure 2A:
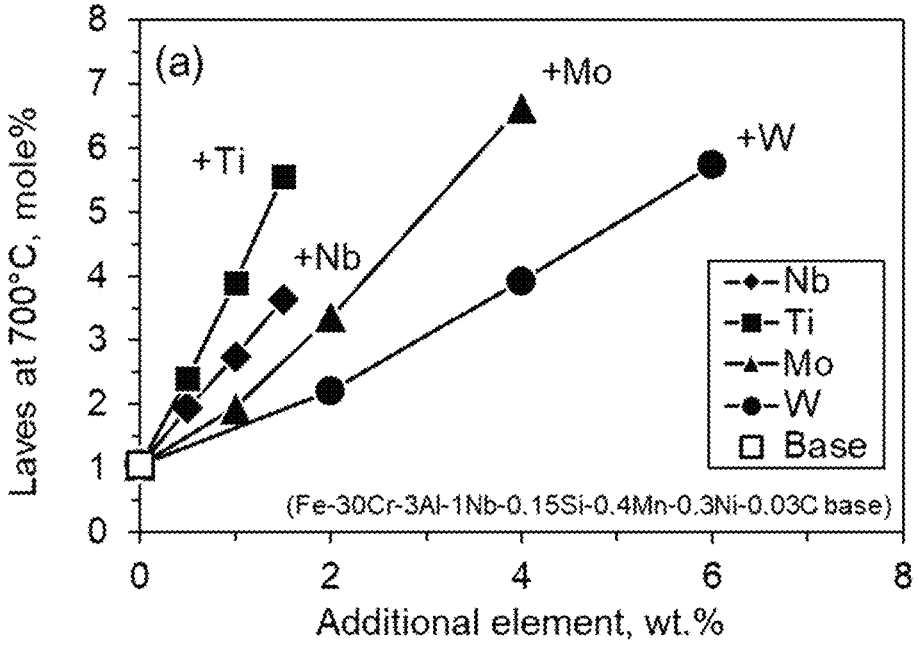
FIGS. 2A and 2B are graphs demonstrating effects of third element additions on FIG. 2A: Calculated Laves-phase at 700° C., mole % vs. Additional element, wt. %.
Figure 2B:
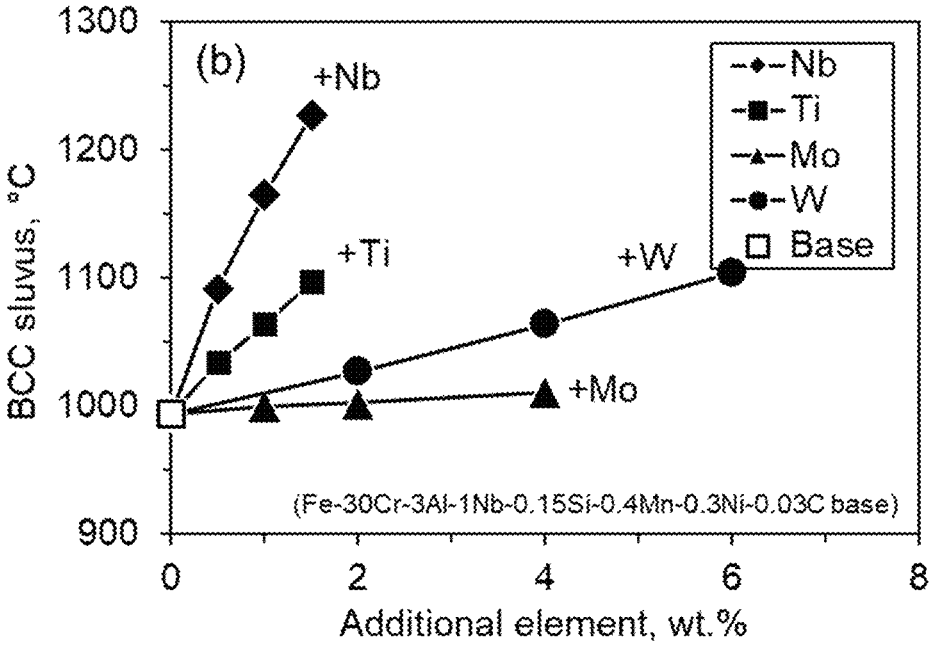

A base alloy composition of Fe-30Cr-3Al-1Nb was prepared and provided oxidation resistance from Al, and corrosion resistance from Cr, together with a fine dispersion of Laves phase from Nb. Minor impurity elements of Si, Mn, Ni, and C were also considered to simulate an industrial grade alloy. FIG. 2 are graphs demonstrating the effects of third element additions on (FIG. 2 A) the calculated mole fraction of Laves-phase at 700° C. and (FIG. 2 B) the BCC solvus temperature in Fe-30Cr-3Al-1Nb-0.15Si-0.4Mn-0.3Ni-0.03C base alloys, calculated by Thermo-Calc® (with a TCFE9 database). Thermodynamic calculations indicated that further additions of Nb and Ti in the alloy based on Fe-30Cr-3Al-1Nb-0.15Si-0.4Mn-0.3Ni-0.03C, wt. %, increase the mole fraction of Laves phase at 700° C. immediately (1.7 and 3.2 mole %/wt. %, respectively) compared to the additions of Mo and W (1.6 and 0.9 mile %/wt. %, respectively), as shown in FIG. 2A. The additions of Nb and Ti also raise the BCC solvus temperature rapidly (136 and 63° C./wt. %, respectively) compared to Mo and W (4 and 19° C./wt. %, respectively), as shown in FIG. 2B. The addition of Mo is provided for a large amount of Laves phase at 700° C.+low BCC solvus temperature, although the addition of 1.5 Mo in the Fe-30Cr-3Al-0.2Si-1Nb base alloy caused a significant embrittlement which was due to a strong stabilization effect of Mo on brittle sigma (σ-FeCr) or chi (χ-FeCrMo) phases formed in the BCC matrix. The addition of W is most preferable for increasing the amount of the Laves phase while maintaining the BCC solvus temperature relatively low, and without significant detriment in oxidation and corrosion resistance. An excess amount of Laves phase and/or additions such as Nb or W can degrade oxidation and corrosion under some circumstances. The Nb content requires at preferably 1 wt. % for the oxidation and ash-corrosion resistance as described later, and no more than 2 wt. % to limit the BCC solvus temperature below 1200° C. Heat treatment temperatures above this are not readily available from many potential commercial manufacturers. The amount of Ti is limited below 0.3 wt. % to avoid potential degradation effect on the oxidation resistance since excess Ti addition destabilizes the protective alumina-scale relative to non-protective Fe—Cr rich oxides. The amount of Mo is limited up to 0.5 wt. % since excess Mo addition promotes embrittlement through the formation of brittle phases. The amount of N is limited to 0.02 wt. % due to formation of detrimental AlN precipitates, which can degrade mechanical properties and oxidation resistance.

Table 2 lists the nominal alloy compositions of the alloys prepared and investigated for creep, oxidation, corrosion testing, as well as microstructure control described later. The alloys contain 30 wt. % Cr and 3 wt. % Al to yield surface protection in oxidizing and corrosive environments via a continuous alumina ($Al_2O_3$)-base oxide scale. The alloys provide a ferritic matrix from liquidus to room temperature due to the strong BCC stabilizing effect of both Cr and Al. Additional minor alloying elements, such as Nb, W, Mo, and Ti, form $Fe_2M$ type C14 Laves phase. The Si addition targets refine the size of the Laves phase precipitates in the BCC matrix. Some alloys contain small amounts of Y to improve oxidation resistance by doping of the alumina scale to slow its growth rate and improve its adherence. Mn, Ni, and C are typical impurities in ferritic alloys and can be expected with industrial grade alloy production and must be tolerated. In particular, the alloys of the present invention do not utilize conventional strengthening phases such as C or N additions to form carbides, nitrides, carbonitrides, and mixes of these type phases, as they detract from the availability of elements used for the $Fe_2M$ type C14 Laves phase strengthening precipitates. The alloys consisting of major and minor elements are sometimes referred to hereafter as "model" alloys, and the alloys with further additions of Mn, Ni, and C to represent expected impurities in commercial scale production are sometimes hereafter referred to as "engineering" alloys. The addition of Zr between 0.1 and 0.3 wt. % refines the grain size of the BCC matrix after applying a thermo-mechanical treatment, targeting the improvement of room-temperature ductility. The Ce additions between 0.02 and 0.04 wt. % changes the grain morphology of the as-cast BCC matrix from columnar to equi-axed, targeting the isotropic mechanical properties in the as-cast and the welded materials.

For creep property evaluation, the creep test data of 316H austenitic stainless steel (Fe-18Cr-12Ni-Mo base) and Gr 92 Ferritic-Martensitic steel (Fe-9CR-2W-0.5Mo base) were used for comparison. For oxidation and corrosion testing, two reference binary Fe—Cr alloys (Fe-25Cr and -30Cr) and 310H austenitic stainless steel (Fe-25Cr-20Ni-Nb) were prepared. It should be emphasized that the FeCrAl alloys of the invention have favorable thermal properties compared to austenitic stainless steels, such as lower thermal expansion and higher thermal conductivity than austenitic stainless steels, which allow the alloys to avoid known issues in austenitic stainless steels, such as dissimilar joints, thermal fatigue, oxides spallation during thermal cycles, and so on.

TABLE 2

Nominal alloy composition investigated.

| ID | Fe | Cr | Al | Nb | W | Mo | Ti | Zr | Si | Y | Mn | Ni | C | B | Ce | Remarks |
|---|---|---|---|---|---|---|---|---|---|---|---|---|---|---|---|---|
| CC01 | Bal. | 30 | 3 | 1 | | | | | 0.2 | | | | | | | 1Nb |
| CC02 | Bal. | 30 | 3 | 1 | | | | 0.3 | 0.2 | | | | | | | 1Nb-0.3Zr |
| CC03 | Bal. | 30 | 3 | 1 | | | | 0.3 | 0.2 | | | | | | | 1Nb-0.1Zr |
| CC04 | Bal. | 30 | 3 | | | | | | 0.2 | | | | | | | 0Nb |
| CC05 | Bal. | 30 | 3 | 2 | | | | | 0.2 | | | | | | | 2Nb |
| CC05-6 | Bal. | 30 | 2.6 | 2 | | | | | 0.2 | | | | | | | 2.6Al-2Nb |
| CC05-7 | Bal. | 30 | 3 | 2 | | | | | 0.2 | | | | | | | 3Al-2Nb, nominally identical to CC05 |

TABLE 2-continued

Nominal alloy composition investigated.

| ID | Fe | Cr | Al | Nb | W | Mo | Ti | Zr | Si | Y | Mn | Ni | C | B | Ce | Remarks |
|---|---|---|---|---|---|---|---|---|---|---|---|---|---|---|---|---|
| CC06 | Bal. | 30 | 3 | 2 | | | | 0.1 | 0.2 | | | | | | | 3Al-2Nb-0.1Z |
| CC07 | Bal. | 30 | 2 | 2 | | | | 0.1 | 0.2 | | | | | | | 2Al-2Nb-0.1Zr |
| CC08 | Bal. | 30 | 1 | 2 | | | | 0.1 | 0.2 | | | | | | | 1Al-2Nb-0.1Zr |
| CC09 | Bal. | 30 | 3 | 1 | 2 | | | | 0.2 | | | | | | | 1Nb-2W |
| CC09-3 | Bal. | 30 | 3 | 1 | 2 | | | | 0.2 | | | | | | | 1Nb-2W |
| CC10 | Bal. | 30 | 3 | 1 | | 1.5 | | | 0.2 | | | | | | | 1Nb-1.5Mo |
| CC11-3 | Bal. | 30 | 3 | 1 | | | 0.5 | | 0.2 | 0.03 | | | | | | 1Nb-0.5Ti |
| CC13 | Bal. | 25 | 3 | 2 | | | | | 0.2 | 0.03 | | | | | | 25Cr-3Al-2Nb |
| CC14 | Bal. | 30 | 3 | 1 | 2 | 0.5 | 0.3 | | 0.15 | 0.03 | 0.4 | | 0.03 | | | 1Nb-2W-0.5Mo-0.3Ti with Mn, Si, C |
| CC15 | Bal. | 30 | 3 | 1 | 6 | 0.5 | 0.3 | | 0.15 | 0.03 | 0.4 | | 0.03 | | | 1Nb-6W-0.5Mo-0.3Ti with Mn, Si, C |
| CC15-2 | Bal. | 30 | 3 | 1 | 6 | 0.5 | 0.3 | | 0.15 | 0.03 | 0.4 | | 0.03 | | | Nominally identical to CC15 |
| CC16 | Bal. | 30 | 3 | 1 | 6 | 0.5 | 0.3 | | 0.15 | 0.03 | 0.4 | 1 | 0.03 | | | 1Ni |
| CC17 | Bal. | 30 | 3 | 1 | 6 | 0.5 | 0.3 | | 0.15 | 0.03 | 0.4 | 1 | 0.03 | 0.01 | | 1Ni-0.01B |
| CC26 | Bal. | 30 | 3 | 1 | 6 | 0.5 | 0.3 | — | 0.15 | 0.03 | 0.4 | 0.3 | 0.03 | | | 0.3Ni |
| CC29 | Bal. | 30 | 3 | 1 | 6 | 0.5 | | 0.5 | 0.2 | 0.03 | 0.4 | 0.3 | 0.03 | | | 0Ti-0.5Zr |
| CC30 | Bal. | 30 | 3 | 1 | 6 | 0.5 | | 1 | 0.2 | 0.03 | 0.4 | 0.3 | 0.03 | | | 0Ti-1Zr |
| CC31 | Bal. | 30 | 3 | 1 | 6 | | | 0.1 | 0.15 | 0.03 | 0.4 | 0.3 | 0.03 | | | 0.1Zr |
| CC32 | Bal. | 30 | 3 | 1 | 6 | | | 0.3 | 0.15 | 0.03 | 0.4 | 0.3 | 0.03 | | | 0.3Zr |
| CC33 | Bal. | 30 | 3 | 1 | 6 | | | 0.3 | 0.15 | | 0.4 | 0.3 | 0.03 | | | 0.3Zr-0Y |
| CC34 | Bal. | 30 | 3 | 1 | 6 | | | 0.3 | 0.15 | | 0.4 | 0.3 | 0.03 | | 0.03 | 0.3Zr-0Y-0.03Ce |
| CC35 | Bal. | 30 | 3 | 1 | 6 | | | 0.3 | 0.2 | | 0.4 | 0.3 | 0.03 | | 0.03 | 0.25i-0.03C |
| CC36 | Bal. | 30 | 3 | 1 | 6 | | | 0.3 | 0.2 | | 0.4 | 0.3 | 0.1 | | 0.03 | 0.25i-0.10C |
| CC37 | Bal. | 30 | 3 | 1 | 6 | | | 0.3 | 0.2 | | 0.4 | 0.3 | 0.03 | | 0.03 | Nominally identical to CC35 (VIM) |
| RF30C | Bal. | 30 | | | | | | | | | | | | | | Binary Fe-30Cr (reference) |
| RF25C | Bal. | 25 | | | | | | | | | | | | | | Binary Fe-25Cr (reference) |
| Gr 92 | Bal. | 9 | | 0.05 | 1.8 | 0.5 | | | 0.3 | | 0.4 | 0.2 | 0.1 | | | 9Cr-2W-0.5Mo Ferritic-Martensitic Steel (reference) |
| 316H | Bal. | 17 | | | | 2.5 | | | 0.6 | | 1.6 | 13.5 | 0.06 | | | Austenitic SS 18Cr-12Ni-Mo (reference) |
| 310H | Bal. | 25 | | 0.4 | | | | | 0.3 | | 1.2 | 20 | 0.06 | | | Austenitic SS 25Cr-20Ni-Nb (reference) |

Figure 3:
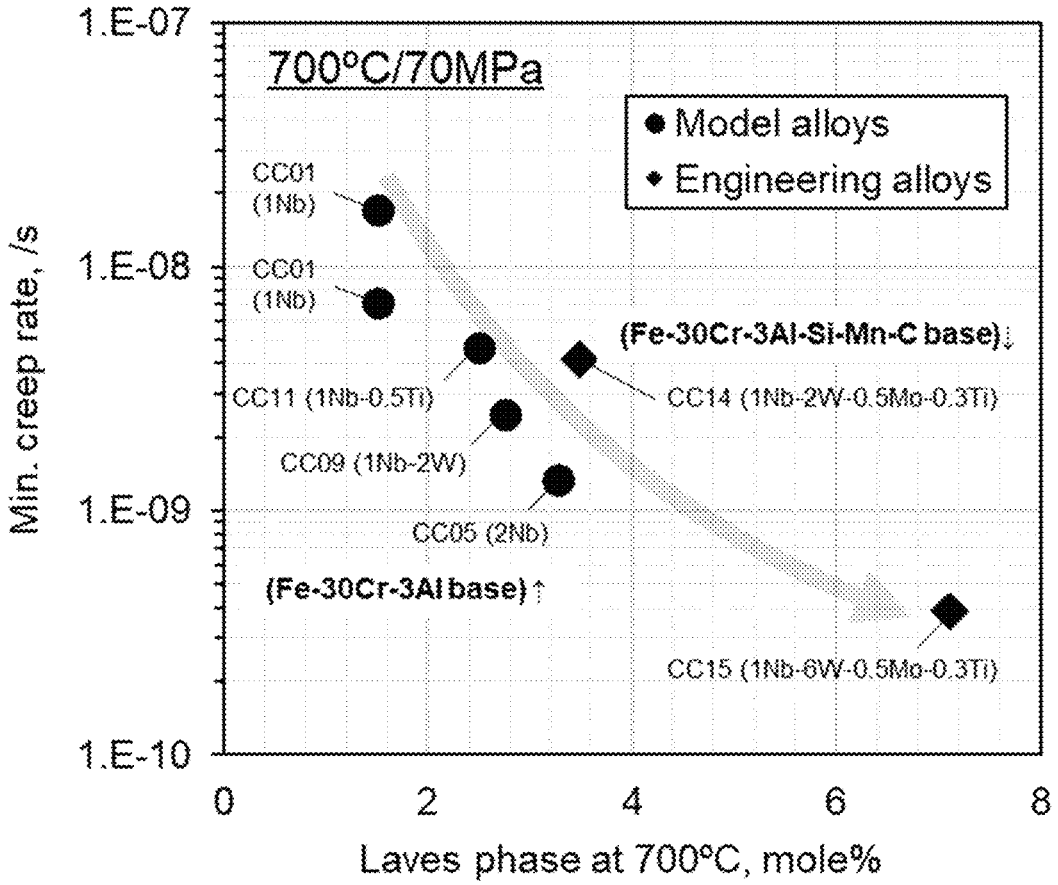
FIG. 3 is a graph demonstrating minimum creep rate, /s, at 700° C. and 70 MPa of Fe-30Cr-3Al base alloys with third element additions, plotted as a function of the calculated amount of Laves phase at 700° C., mole %.
Figure 4A:
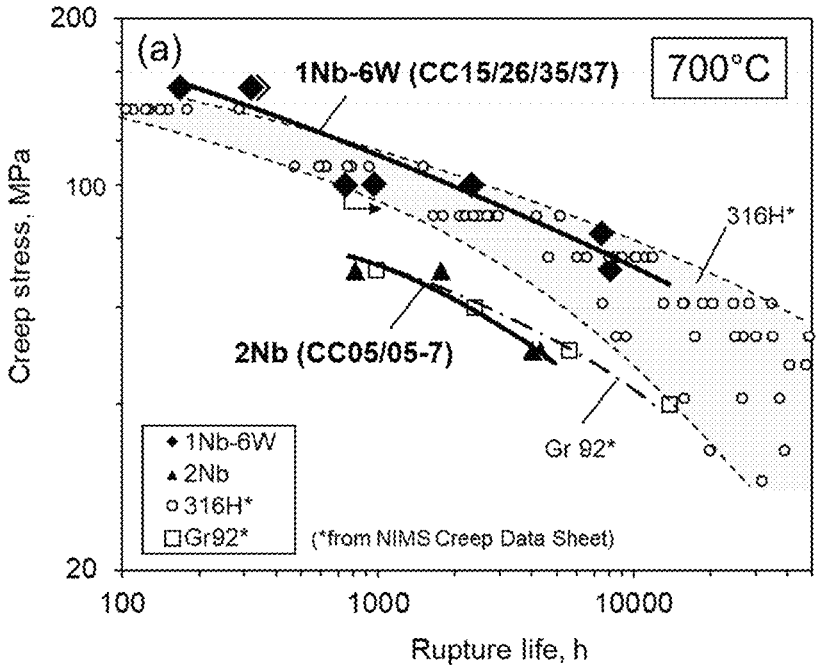
FIGS. 4A and 4B are graphs of creep stress, MPa, vs rupture life, h, for Fe-30Cr-3Al base alloys with 2Nb (model alloy) and 1Nb-6W (engineering alloy) compared to Gr 92 ferritic-martensitic steel and 316H austenitic stainless steel.
Figure 4B:
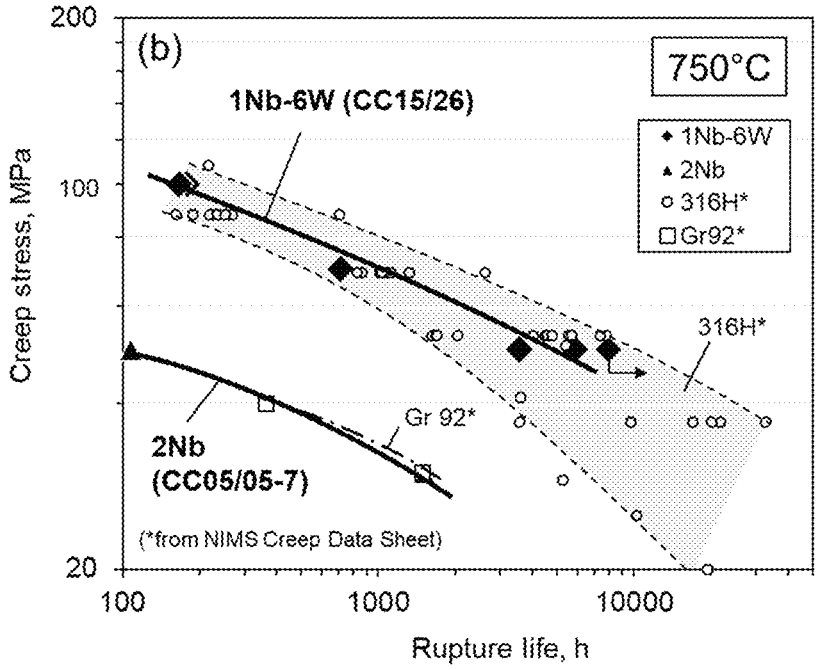

The minimum creep rates at 700° C. and 70 MPa were experimentally obtained from both model and engineering alloys, which showed monotonic, negative dependence on the calculated mole fraction of Laves phase at 700° C. (FIG. 3). FIG. 3 is a graph demonstrating minimum creep rates of Fe-30Cr-3Al base alloys with third element additions at 700° C. and 70 MPa, plotted as a function of the calculated amount of Laves phase at 700° C. An increase in the amount of Laves phase precipitates provides better for the creep resistance of the alloys. FIGS. 4A and 4B are graphs demonstrating the creep-rupture life of Fe-30Cr-3Al base alloys with 2Nb (model alloy) and 1Nb-6W (engineering alloy) compared to Gr 92 ferritic-martensitic steel and 316H austenitic stainless steel. FIG. 4A illustrates testing at 700° C., and FIG. 4B illustrates testing at 750° C. The arrows indicate that the tests were continuing after the graphs were prepared. As summarized in FIG. 4, the model alloy with 2Nb showed comparable creep strength to Gr 92 steel, and the engineering alloy with 1Nb-6W reached the creep strength comparable to 316H austenitic stainless steel in the temperature range of 700-750° C. The creep-rupture data of commercial ferritic stainless steels, such as type 409 (Fe-12Cr base, Ti/Nb modified) or 439/441 (Ti/Nb modified Fe-18Cr base), at the same/similar test conditions are not publicly available, although the extrapolated rupture-lives of these steels are significantly below the range in the plots in FIG. 4, indicating the strong advantage of the alloys of the invention in high-temperature creep strength.

Figure 5A:
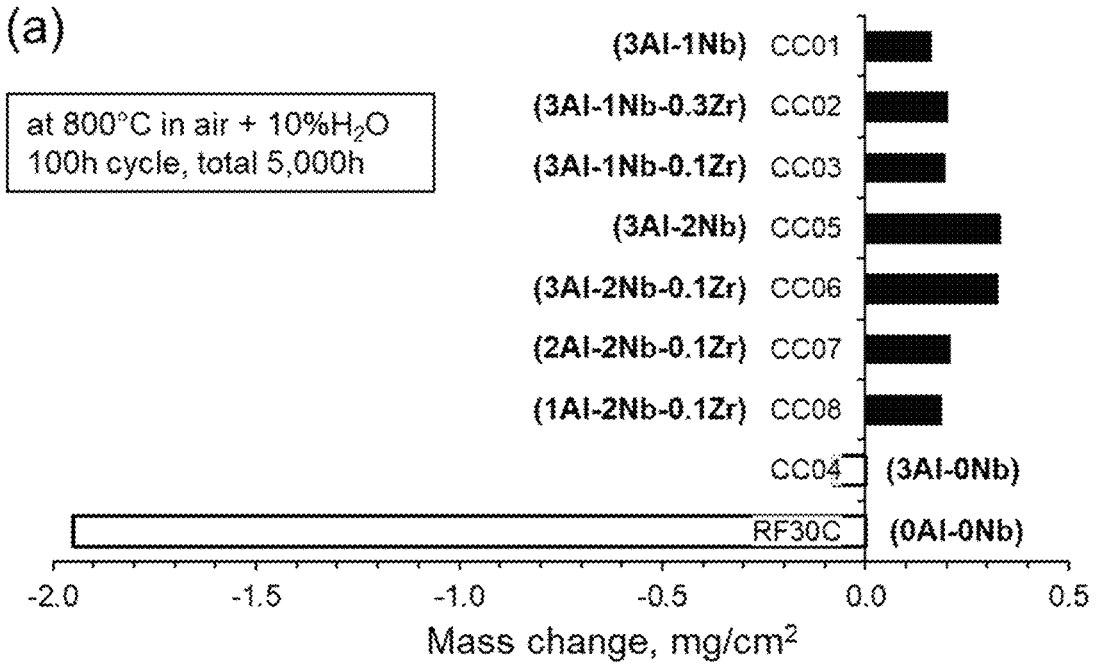
FIGS. 5A and 5B are graphs demonstrating mass changes ($mg/cm^2$) in Fe-30Cr-3Al base alloys after total 5,000 h exposure at 800° C. in air+10 vol. % water vapor.
Figure 5B:
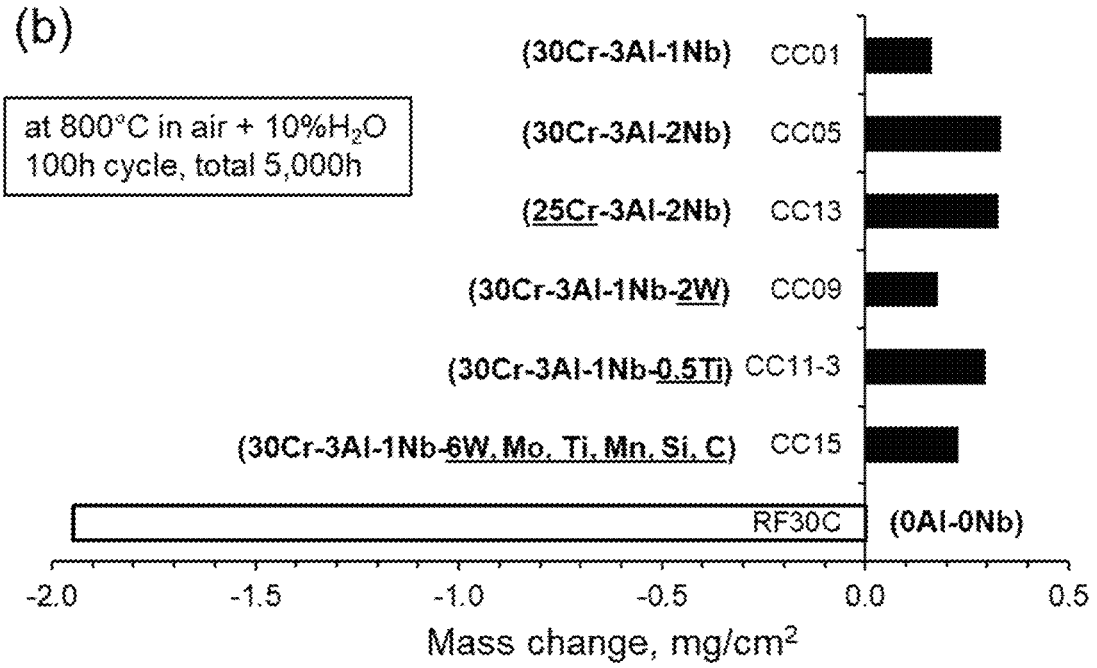

Protective oxidation resistance in water-vapor containing environments at elevated temperatures was achieved by the combined additions of Al and Nb. FIG. 5 represents the mass changes in the Fe-30Cr-3Al base alloys after total 5,000 h exposure at 800° C. in air+10 volume percent water vapor. FIGS. 5A and 5B are graphs demonstrating mass changes in Fe-30Cr-3Al base alloys after total 5,000 h exposure at 800° C. in air+10 vol. % water vapor. The FIG. 5A alloys have various amounts of Al, Nb, Zr, and the FIG. 5B alloys have various amounts of Cr, W, Ti, Mo, as compared with a reference binary Fe-30Cr alloy. In FIG. 5A, limited mass gains up to ~0.4 mg/cm$^2$ were observed in the alloys with 1 to 3Al and 1 to 2Nb, indicating a good oxidation resistance. The limited mass gains also indicated the formation of protective, external alumina-scale. Alumina-scale grows 1 to 2 orders of magnitude slower than chromia formers such as FM steels and austenitic stainless steels, and is far more stable in water vapor. The addition of Zr between 0 and 0.3 wt. % did not impact on the oxidation resistance positively/negatively. The alloy with 3Al and 0Nb exhibited slightly negative mass change, suggesting less protectiveness than the other alloys containing Nb. The alloy with no Al and Nb resulted in poor oxidation resistance due to significant loss of the mass because of volatilization of $CrO_2(OH)_2$ during oxidation testing. In FIG. 5B, the alloy with less Cr content (25 wt. %) or with a substitution of W or Ti for Nb did not deteriorate the oxidation resistance when the alloys contained at least 1Nb. The addition of 6W combined with Mo, Ti, and other minor impurities also showed no negative impact on the oxidation resistance.

Figure 6:
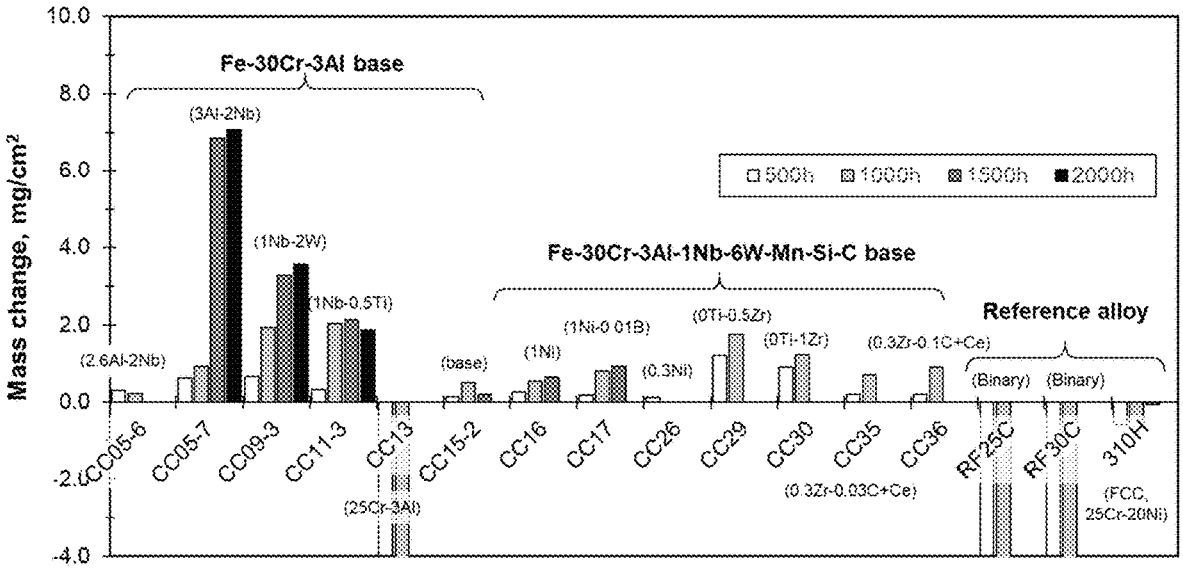
FIG. 6 is a graph demonstrating mass changes ($mg/cm^2$) in Fe-30Cr-3Al base alloys exposed in a synthetic gas and mixed ashes at 700° C. and 500 h cycle (ash: 7.8% $Fe_2O_3$-16.9% $Al_2O_3$-22.6% $SiO_2$-0.9% CaO-1% KOH-0.6% $TiO_2$-0.2% MgO-19.8% $Fe_2(SO_4)_3$-10.1% $MgSO_4$-15.1% $Na_2SO_4$, gas: 63% $CO_2$-5% $N_2$-1.5% $O_2$-30% $H_2O$-0.5% $SO_2$).

The improved ash-corrosion resistance was achieved by a combination of high Cr content (~30 wt. %) with 3Al, 1Nb, and 6 W additions. FIG. 6 is a graph demonstrating mass changes in Fe-30Cr-3Al base alloys exposed in a synthetic gas and mixed ashes at 700° C. and 500 h cycle. The synthetic ash was formulated as: 7.8% $Fe_2O_3$-16.9% $Al_2O_3$-22.6% $SiO_2$-0.9% CaO-1% KOH-0.6% $TiO_2$-0.2% MgO-19.8% $Fe_2(SO_4)_3$-10.1% $MgSO_4$-15.1% $Na_2SO_4$, gas: 63% $CO_2$-5% $N_2$-1.5% $O_2$-30% $H_2O$-0.5% $SO_2$. The synthetic ash and gas in the presented evaluation contained major corrosive components composing various ash products and combustion gases in any other fossil-fired thermal power plants, so that the experimentally obtained corrosion resistance of the invented alloys should also be generically acceptable in other combinations of ashes and gases.

FIG. 6 compares the mass changes in the alloys after 500 h cyclic exposure in a corrosive environment of the synthetic ash and gas at 700° C., simulating a fire side circumstance in fossil-fired thermal power plants. The model alloys based on Fe-30Cr-3Al, including 3Al-2Nb, 1Nb-2W, and 1Nb-0.5Ti, showed relatively large amount of mass gains (more than 2 mg/cm$^2$) after more than 1,000-1,500 h exposure, indicating that these alloys do not have good surface protection for prolonged exposure in the corrosive environment. The alloy with 25Cr-3Al showed a significant mass loss after the first cycle, suggesting that the higher Cr content the better corrosion resistance. The engineering alloys based on Fe-30Cr-3Al-1Nb-6W mostly showed a limited mass gains not exceeding ~1.5 mg/cm$^2$ even after >1,000 h exposure. It was also found that various combinations of minor alloying additions of Mo, Ti, Mn, Si, C, Ni, Zr, and Ce did not negatively impact on the mass gains compared to the model alloys. The binary alloys Fe-25Cr and Fe-30Cr showed a significant mass loss due to poor corrosion resistance, and 310H austenitic stainless steel (Fe-25Cr-20Ni-Nb base) also showed mass loss in the same corrosive environment.

Figure 7A:
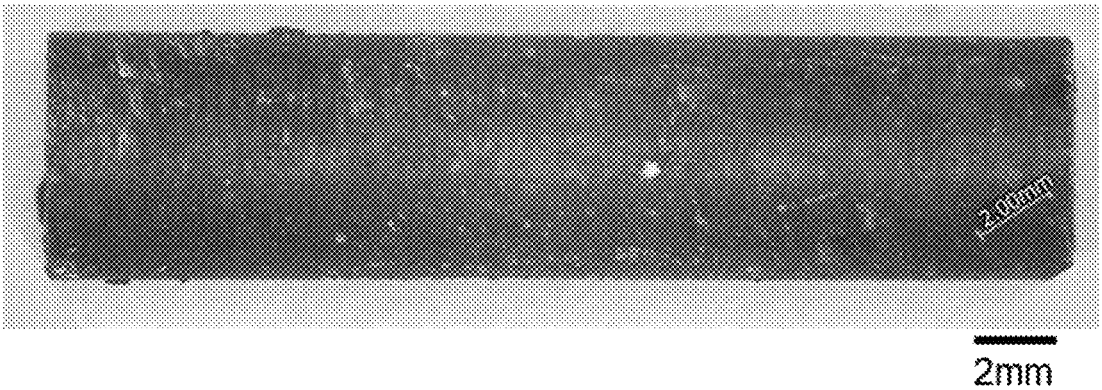
FIGS. 7A and 7B are rod specimens after exposing in a synthetic gas and mixed ashes at 700° C.
Figure 7B:
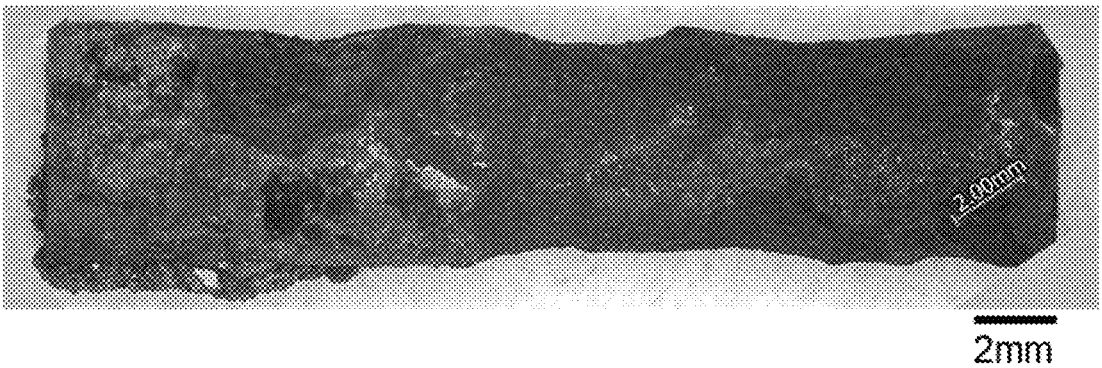

The rod shape specimens of 1Nb-6W (CC15-2) and binary Fe-30Cr (RF30C) after testing are shown in FIG. 7, representing the visual damage from the corrosion environment. FIGS. 7A and 7B are rod specimens after exposing in a synthetic gas and mixed ashes at 700° C. FIG. 7A shows the Fe-30Cr-3Al-1Nb-6W base alloy (CC15-2), total 1500 h exposure, and FIG. 7B shows a reference binary Fe-30Cr (RF30C), after 500 h exposure. The former (FIG. 7A) remains in a rod shape with no apparent surface damage, whereas the latter (FIG. 7B) shows a significant volume loss.

Figure 8:
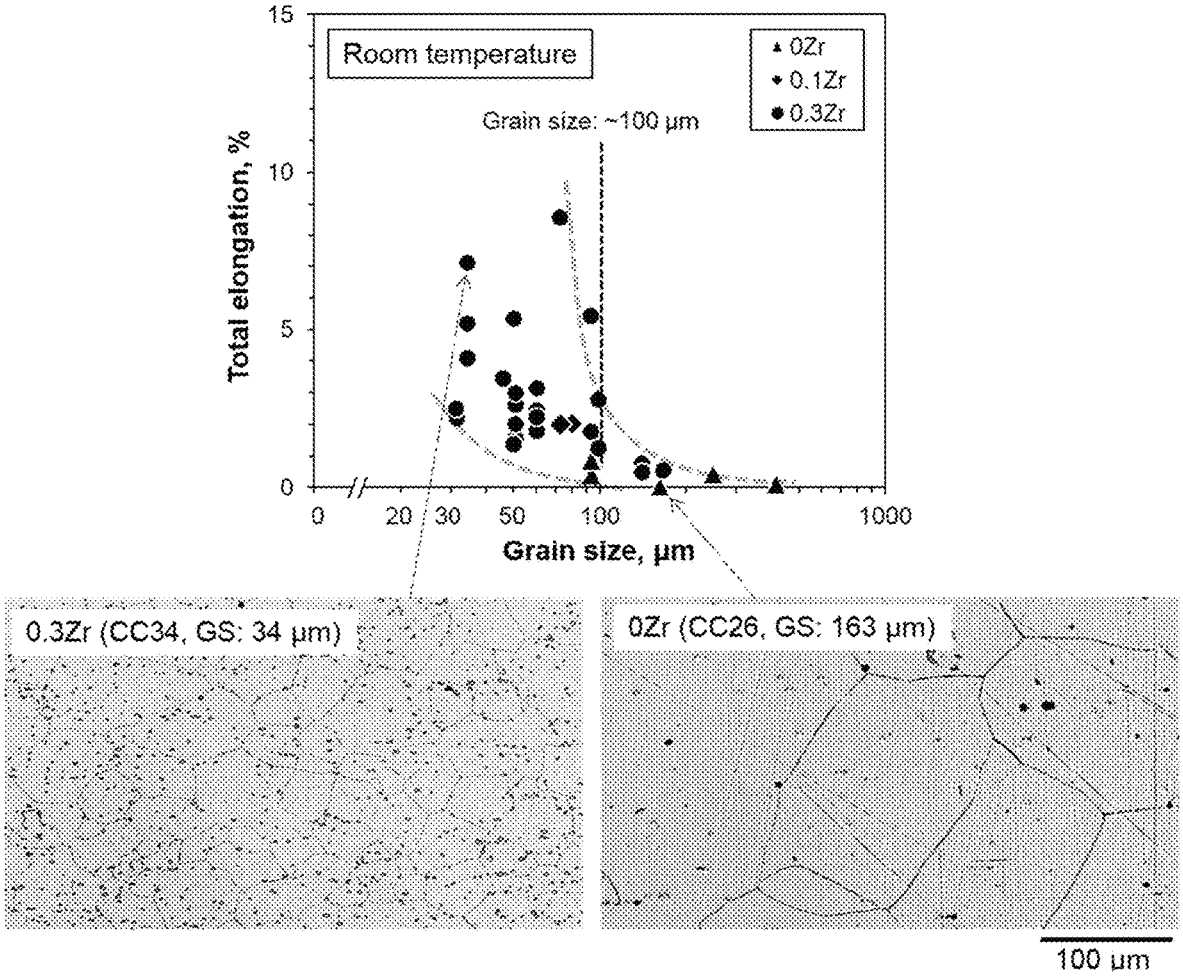
FIG. 8 is a graph of total elongation, % vs. grain size, μm, that demonstrates the effect of grain size on room-temperature ductility in Fe-30Cr-3Al-1Nb-6W base alloys (CC26 and CC31 through CC37), together with inset images showing the microstructure of the alloys tested (CC34 with 0.3Zr and CC26 with 0Zr).

In addition to the high-temperature creep/oxidation/corrosion resistance, the alloys provide grain refinement to avoid poor ductility at room temperature. FIG. 8 is an image and graph that demonstrates the effect of grain size on room-temperature ductility in Fe-30Cr-3Al-1Nb-6W base alloys (CC26 and CC31 through CC37), together with examples of the microstructure of the alloys tested (CC34 with 0.3Zr and CC26 with 0Zr). FIG. 8 illustrates the effect of grain size on room-temperature ductility of the Fe-30Cr-3Al-1Nb-6W base alloys, which indicates that grain sizes between 10 to 100 μm provide at least 1% of tensile elongation. The grain size refinement can be achieved by a combination of the addition of Zr between 0.1 and 0.3 wt. % and a thermomechanical treatment. The addition of Zr will result in elemental segregation of Zr on the grain boundary which increases the dragging effect to make the grain boundary motion slower and prevent the grain coarsening during solution heat treatment above the BCC solvus temperature, for example at 1200° C. Fine grain structure will be obtained through a combination of hot-forging and -rolling with total deformation (e.g. thickness reduction) of more than 70% and multiple re-heating process steps at intermediate temperature between 800 and 1000° C. during hot-forging and -rolling, followed by recrystallization through annealing between 1150 to 1250° C., preferred at 1200° C. Deformation of the alloy requires temperatures at or above 800° C. to avoid any premature failure during deformation, such as cracking. The grain refinement of the alloy is not expected when the rolling temperature exceeds 1000° C., because (1) the formation of Laves phase precipitates ties up the elemental Zr to minimize the effect of dragging, and (2) dynamic recovery/recrystallization during each rolling pass prevents accumulation of the stored energy for recrystallization with high nucleation frequency.

Figure 9:
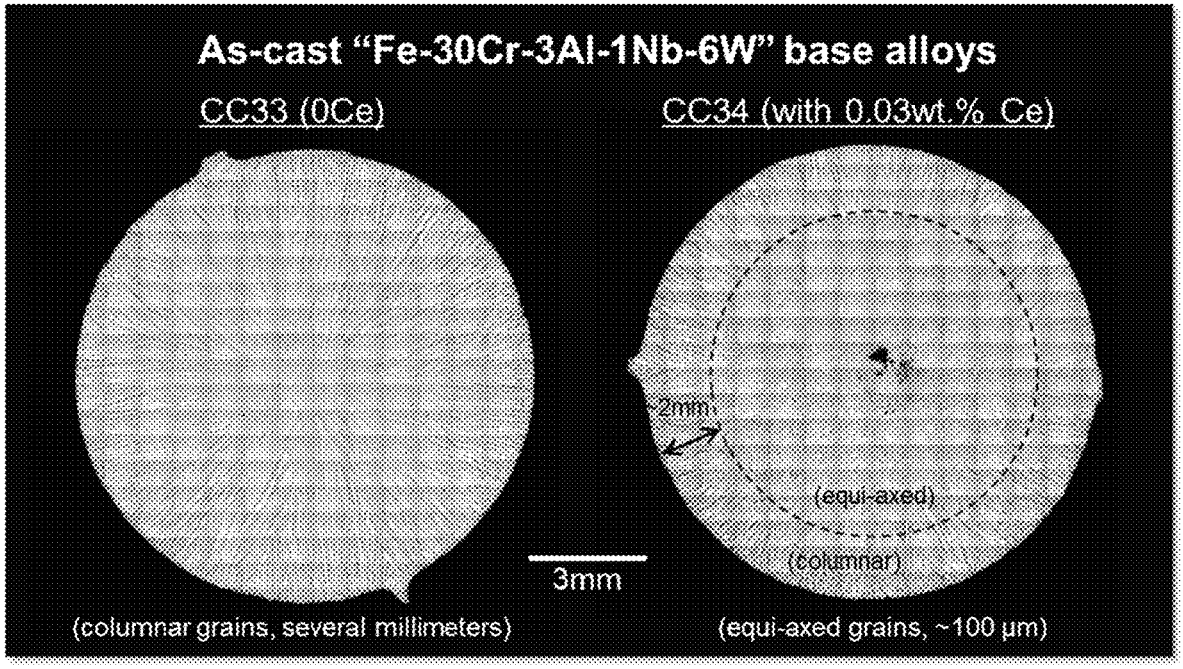
FIG. 9 is an image of grain structure that demonstrates the effect of Ce addition on as-cast microstructure of Fe-30Cr-3Al-1Nb-6W base alloys with left 0Ce and right 0.03 wt. % Ce.

The addition of Ce in the range of 0.02 to 0.04 wt. % changes the grain structure of as-cast material from columnar grains to mostly equi-axed grains, as shown in FIG. 9. FIG. 9 is an image that demonstrates the effect of Ce addition on as-cast microstructure of Fe-30Cr-3Al-1Nb-6W base alloys. The columnar grains form and grow from the crucible wall, but the length is no more than 2 mm and rest of the volume consists of the equi-axed grains. The volume fraction of equi-axed grains increases with increasing the ingot size. This is effective to improve room-temperature toughness of as-solidified materials, including weld metals, due to isotropic microstructure combined with refined grains. It also reduces the chance of crack formation during solidification which is observed in highly-alloyed ferritic steels. The Ce addition does not affect the microstructure evolution through thermo-mechanical treatment, room-temperature ductility, and the high-temperature properties (for example CC35 and CC36 in FIG. 6).

This invention can be embodied in other forms without departing from the spirit or essential attributes thereof. Reference should be made to the following claims to determine the scope of the invention.

We claim:

1. An alloy comprising in weight % based upon the total weight of the alloy:

28-35% Cr
2.5-4% Al
0.8-2% Nb
5.5-7.5% W
0-0.5% Mo
0-0.3% Ti
0.1-0.3% Zr
0.1-1% Si
0-0.07% Y
0-2% Mn
0-1% Ni 0-0.05% C
0-0.015% B
0-0.02% N
0.02-0.04 Ce
balance Fe, the alloy comprising at least 99% recrystallized, at least 99% equi-axed grain structure with an average grain size of 10 to 100 μm, wherein the alloy forms an external continuous scale comprising alumina, and has nanometer scale sized strengthening particles with 5 to 500 nm in size and mole fraction of 5 to 10%, distributed throughout the microstructure, the particles comprising at least one composition selected from the group consisting of $Fe_2M$ (M: Nb, W, Mo, and Ti) type C14 Laves-phase, and a stable essentially single-phase BCC ferritic matrix microstructure from room temperature to melting point, the ferritic matrix being less than 1% FCC-phase, less than 1% martensite phase, less than 0.5 wt. % of carbides (MC and $M_{23}C_6$), with at least 1% tensile elongation at room temperature, and wherein the alloy has an oxidation resistance of a positive specific mass change less than 0.5 mg/cm$^2$ after 5000 h exposure at 800° C. in air with 10 volume percent $H_2O$, an ash-corrosion resistance of a positive specific mass change less than 2 mg/cm$^2$ after 1000 h exposure at 700° C. in a synthetic ash and gas environment, and a creep resistance of greater than 3000 to 15000 h creep rupture life at 750° C. and 50 MPa, and/or greater than 500 to 5000 h creep rupture life at 700° C. and 100 MPa.

2. The alloy of claim 1, wherein Cr is 30-35 wt. %.

3. The alloy of claim 1, wherein Al is 3-4 wt. %.

4. The alloy of claim 1, wherein Nb is 1-2 wt. %.

5. The alloy of claim 1, wherein W is 6-7.5 wt. %.

6. The alloy of claim 1, wherein Si is 0.15-1 wt. %.

7. The alloy of claim 1, wherein Y is 0.01-0.07 wt. %.

8. The alloy of claim 1, wherein Ce is 0.03-0.04 wt. %.

9. The alloy of claim 1, wherein Mn is 0.4 to 2 wt. %.

10. The alloy of claim 1, wherein C is <0.035 wt. %.

11. The alloy of claim 1, wherein B is 0.01 to 0.015 wt. %.

12. The alloy of claim 1, wherein N is 0 to 0.005 wt. %.

13. The alloy of claim 1, wherein the average grain size is 10-50 μm.

14. The alloy of claim 1, wherein the strengthening particles are 5-300 nm.

15. The alloy of claim 1, wherein the mole fraction of the particles is 6-8%.

16. The alloy of claim 1, wherein the alloy consists essentially of:

28-35% Cr
2.5-4% Al
0.8-2% Nb
5.5-7.5% W
0-0.5% Mo
0-0.3% Ti
0.1-0.3% Zr
0.1-1% Si
0-0.07% Y
0-2% Mn
0-1% Ni
0-0.05% C
0-0.015% B
0-0.02% N
0.02-0.04 Ce
balance Fe and no more than 1% of trace elements.

17. The alloy of claim 1, wherein the alloy consists of:

28-35% Cr
2.5-4% Al
0.8-2% Nb
5.5-7.5% W
0-0.5% Mo
0-0.3% Ti
0.1-0.3% Zr
0.1-1% Si
0-0.07% Y
0-2% Mn
0-1% Ni
0-0.05% C
0-0.015% B
0-0.02% N
0.02-0.04 Ce
balance Fe.

18. A method of making an alloy, comprising the steps of: providing an alloy precursor composition comprising 28-35% Cr
2.5-4% Al
0.8-2% Nb
5.5-7.5% W
0-0.5% Mo
0-0.3% Ti
0.1-0.3% Zr
0.1-1% Si
0-0.07% Y
0-2% Mn
0-1% Ni
0-0.05% C
0-0.015% B
0-0.02% N
0.02-0.04 Ce
balance Fe; and, heating the alloy precursor composition to form an alloy, and subjecting the alloy to a controlled thermomechanical treatment consisting of a combination of hot-forging and -rolling with total deformation more than 70% and multiple reheating process steps at an intermediate temperature between 800 and 1000° C. during hot-forging and -rolling, followed by recrystallization through annealing at a temperature between 1150 to 1250° C., to achieve a fully recrystallized, equi-axed grain structure with the average grain size of 10 to 100 μm, and at least 1% tensile elongation at room temperature.

19. The method of claim 18, wherein the annealing temperature is 1200° C.

20. The method of claim 18, wherein the average grain size is 10 to 50 μm.

* * * * *